US009080388B2

(12) United States Patent
Heijnen et al.

(10) Patent No.: US 9,080,388 B2
(45) Date of Patent: Jul. 14, 2015

(54) DEVICE AND A SYSTEM AND A METHOD OF MOVING IN A TUBULAR CHANNEL

(75) Inventors: Wilhelmus Hubertus Paulus Maria Heijnen, Stromberg (DE); David Ian Brink, Houston, TX (US)

(73) Assignee: MAERSK OIL QATAR A/S, Copenhagen K (DK)

( * ) Notice: Subject to any disclaimer, the term of this patent is extended or adjusted under 35 U.S.C. 154(b) by 330 days.

(21) Appl. No.: 13/504,826

(22) PCT Filed: Oct. 28, 2010

(86) PCT No.: PCT/EP2010/066376

§ 371 (c)(1),
(2), (4) Date: Aug. 2, 2012

(87) PCT Pub. No.: WO2011/051397

PCT Pub. Date: May 5, 2011

(65) Prior Publication Data

US 2012/0292049 A1 Nov. 22, 2012

Related U.S. Application Data

(60) Provisional application No. 61/256,680, filed on Oct. 30, 2009.

(30) Foreign Application Priority Data

Oct. 30, 2009 (DK) ..... 2009 70181

(51) Int. Cl.
*E21B 23/00* (2006.01)
*E21B 4/18* (2006.01)

(Continued)

(52) U.S. Cl.
CPC . *E21B 4/18* (2013.01); *E21B 23/14* (2013.01); *E21B 33/127* (2013.01); *E21B 2023/008* (2013.01)

(58) Field of Classification Search
CPC ... E21B 2023/008; E21B 33/127; E21B 4/18; E21B 7/06; E21B 7/067
USPC ..... 166/381, 101, 50; 175/94, 98, 99, 230
See application file for complete search history.

(56) References Cited

U.S. PATENT DOCUMENTS 2,122,697 A 10/1935 Potter
2,271,005 A * 1/1942 Grebe ..... 175/61

(Continued)

FOREIGN PATENT DOCUMENTS

DE 2358371 A1 5/1975
EP 1223305 A2 7/2009

(Continued)

OTHER PUBLICATIONS

International Search Report for International Application No. PCT/EP2010/066376, dated Dec. 8, 2010.

(Continued)

*Primary Examiner* — Jennifer H Gay
(74) *Attorney, Agent, or Firm* — Brinks Gilson & Lione

(57) ABSTRACT

A device for moving in a tubular channel comprises two gripper fluidly connected via a pump. A first gripper comprises a fluid. The pump is adapted to inflate a second gripper by pumping the fluid from the first gripper to the second gripper. The grippers comprises a flexible member contained in a woven member. The flexible member provides fluid-tightness and the woven member provides the shape of the grippers.

20 Claims, 6 Drawing Sheets

(51) Int. Cl.

| | |
|---|---|
| ***E21B 33/127*** | (2006.01) |
| ***E21B 7/06*** | (2006.01) |
| ***E21B 7/26*** | (2006.01) |
| ***E21B 23/14*** | (2006.01) |

(56) References Cited

U.S. PATENT DOCUMENTS

| | | | | |
|---|---|---|---|---|
| 3,926,254 | A | 12/1975 | Evans et al. | |
| 3,937,278 | A | 2/1976 | Sheshtawy | |
| 4,320,800 | A | 3/1982 | Upchurch | |
| 4,365,676 | A | 12/1982 | Boyadjieff et al. | |
| 4,372,161 | A * | 2/1983 | de Buda et al. | 73/865.8 |
| 4,611,405 | A | 9/1986 | Van Steenwyk | |
| 4,621,532 | A | 11/1986 | Takagi et al. | |
| 4,919,223 | A | 4/1990 | Egger et al. | |
| 5,070,941 | A | 12/1991 | Kilgore | |
| 5,558,153 | A | 9/1996 | Holcombe et al. | |
| 5,758,731 | A * | 6/1998 | Zollinger | 175/99 |
| 5,955,666 | A | 9/1999 | Mullins | |
| 6,241,028 | B1 | 6/2001 | Biileveld et al. | |
| 6,241,031 | B1 * | 6/2001 | Beaufort et al. | 175/99 |
| 6,253,850 | B1 | 7/2001 | Nazzal et al. | |
| 6,478,097 | B2 * | 11/2002 | Bloom et al. | 175/51 |
| 6,679,341 | B2 * | 1/2004 | Bloom et al. | 175/51 |
| 6,845,819 | B2 | 1/2005 | Barrett et al. | |
| 7,059,417 | B2 * | 6/2006 | Moore et al. | 166/381 |
| 7,080,700 | B2 * | 7/2006 | Bloom et al. | 175/51 |
| 7,174,974 | B2 | 2/2007 | Bloom et al. | |
| 7,188,681 | B2 * | 3/2007 | Bloom et al. | 175/51 |
| 7,230,541 | B2 | 6/2007 | Ripolone et al. | |
| 7,353,886 | B2 * | 4/2008 | Bloom et al. | 175/51 |
| 7,392,859 | B2 | 7/2008 | Mock et al. | |
| 7,493,967 | B2 | 2/2009 | Mock et al. | |
| 7,607,495 | B2 * | 10/2009 | Bloom et al. | 175/51 |
| 7,607,497 | B2 | 10/2009 | Mock et al. | |
| 7,954,563 | B2 | 6/2011 | Mock et al. | |
| 8,069,917 | B2 | 12/2011 | Bloom et al. | |
| 8,109,331 | B2 | 2/2012 | Lynde et al. | |
| 8,151,902 | B2 | 4/2012 | Lynde et al. | |
| 8,245,796 | B2 * | 8/2012 | Mock et al. | 175/51 |
| 8,430,810 | B2 * | 4/2013 | Hassidov et al. | 600/116 |
| 8,555,963 | B2 | 10/2013 | Bloom et al. | |
| 8,602,115 | B2 | 12/2013 | Aguirre et al. | |
| 2001/0045300 | A1 | 11/2001 | Fincher et al. | |
| 2002/0007971 | A1 * | 1/2002 | Beaufort et al. | 175/99 |
| 2002/0029908 | A1 * | 3/2002 | Bloom et al. | 175/99 |
| 2002/0088648 | A1 | 7/2002 | Krueger et al. | |
| 2002/0096322 | A1 | 7/2002 | Barrett et al. | |
| 2002/0112859 | A1 * | 8/2002 | Bloom et al. | 166/381 |
| 2002/0190682 | A1 | 12/2002 | Schempf et al. | |
| 2003/0102164 | A1 | 6/2003 | Odell, II et al. | |
| 2003/0192707 | A1 | 10/2003 | Guven et al. | |
| 2004/0065445 | A1 | 4/2004 | Simpson et al. | |
| 2004/0090230 | A1 | 5/2004 | Appel et al. | |
| 2004/0144548 | A1 * | 7/2004 | Bloom et al. | 166/381 |
| 2004/0182580 | A1 | 9/2004 | Moore et al. | |
| 2004/0226746 | A1 | 11/2004 | Schmidt et al. | |
| 2004/0226747 | A1 | 11/2004 | Stegmaier et al. | |
| 2004/0262008 | A1 | 12/2004 | Deans et al. | |
| 2005/0150692 | A1 * | 7/2005 | Ballantyne et al. | 175/61 |
| 2005/0262944 | A1 | 12/2005 | Bennett et al. | |
| 2006/0180316 | A1 | 8/2006 | Steele et al. | |
| 2006/0196694 | A1 | 9/2006 | Bloom et al. | |
| 2007/0000693 | A1 * | 1/2007 | Bloom et al. | 175/51 |
| 2007/0256861 | A1 | 11/2007 | Hulick | |
| 2008/0066963 | A1 | 3/2008 | Sheiretov et al. | |
| 2008/0073077 | A1 | 3/2008 | Tunc et al. | |
| 2008/0121429 | A1 | 5/2008 | Bamford | |
| 2008/0159077 | A1 | 7/2008 | Madhavan et al. | |
| 2008/0211687 | A1 | 9/2008 | Price et al. | |
| 2008/0217059 | A1 * | 9/2008 | Bloom et al. | 175/51 |
| 2008/0308318 | A1 | 12/2008 | Moore | |
| 2009/0200290 | A1 | 8/2009 | Cardinal et al. | |
| 2009/0205840 | A1 | 8/2009 | O'Connor et al. | |
| 2009/0211754 | A1 | 8/2009 | Verret et al. | |
| 2009/0218105 | A1 | 9/2009 | Hill et al. | |
| 2010/0126716 | A1 | 5/2010 | Joseph | |
| 2010/0133006 | A1 | 6/2010 | Shakra et al. | |
| 2011/0067926 | A1 * | 3/2011 | Moore | 175/325.3 |
| 2012/0024539 | A1 * | 2/2012 | Lehr | 166/381 |
| 2012/0292049 | A1 * | 11/2012 | Heijnen et al. | 166/381 |
| 2014/0054031 | A1 | 2/2014 | Heijnen et al. | |

FOREIGN PATENT DOCUMENTS

| | | | |
|---|---|---|---|
| FR | 1561771 | A | 3/1969 |
| GB | 2 234 278 | A | 1/1991 |
| GB | 2 275 066 | A | 8/1994 |
| GB | 2368082 | A | 4/2002 |
| WO | 9812418 | | 3/1998 |
| WO | 0036266 | | 6/2000 |
| WO | WO 02/070943 | A2 | 9/2002 |
| WO | WO 2008/024881 | A1 | 2/2008 |

OTHER PUBLICATIONS

International Preliminary Report on Patentability for International Application No. PCT/EP2010/066376, dated Nov. 30, 2011.

"The Development of Novel Down-Hole Intervention Tools, a Change in Well Technology (SPE 122822)", Proceedings of Offshore Europe, Sep. 8, 2009, pp. 1-14, XP055061112, DOI: 10.2118/122822-MS ISBN: 978-1-55-563261-8, the whole document.

Search Report for DK application PA 2011 70110, Nov. 7, 2011.

Supplemental Search Report for DK application PA_2011_70110, Apr. 16, 2013.

PCT/EP2012/052447 International Search Report and Written Opinion, mailed Jul. 5, 2013.

PCT International-Type Search Report for DK 200901032, dated Apr. 7, 2010,4 pages.

Search Report for Application No. PA 200901032, dated Apr. 13, 2010, 1 page.

International Search Report for corresponding International application No. PCT/EP2010/068762, dated Feb. 7, 2011.

Written Opinion of the International Searching Authority for corresponding International application No. PCT/EP2010/068762, dated Feb. 7, 2011.

Search Report for Danish Application No. PA 2009 70180, completed Jun. 3, 2010.

International Search Report for PCT:EP2010:066233, mailed Feb. 16, 2011.

Written opinion for PCT:EP2010:066233, mailed Feb. 16, 2011.

International Preliminary Report on Patentability for corresponding International application No. PCT:EP2010:068762, dated Nov. 17, 2011.

* cited by examiner

C)

D)

DEVICE AND A SYSTEM AND A METHOD OF MOVING IN A TUBULAR CHANNEL

RELATED APPLICATIONS

This application claims the benefit under 35 U.S.C. §371 of International Patent Application No. PCT/EP2010/066376, having an international filing date of Oct. 28, 2010, which claims priority to Danish Patent Application No. PA 2009 70181, filed Oct. 30, 2009, and U.S. Provisional Application No. 61/256,680, filed Oct. 30, 2009, the contents of all of which are incorporated herein by reference in their entirety.

TECHNICAL FIELD

The invention relates to a device for moving in a tubular channel. The invention further relates to a corresponding system and method.

BACKGROUND

In order to find and produce hydrocarbons e.g. petroleum oil or gas hydrocarbons such as paraffins, naphthenes, aromatics and asphaltics or gases such as methane, a well may be drilled in rock (or other) formations in the Earth.

After the well bore has been drilled in the earth formation, a well tubular may be introduced into the well. The well tubular covering the producing or injecting part of the earth formation is called the production liner. Tubulars used to ensure pressure and fluid integrity of the total well are called casing. Tubulars which bring the fluid in or from the earth formation are called tubing. The outside diameter of the liner is smaller than the inside diameter of the well bore covering the producing or injecting section of the well, providing thereby an annular space, or annulus, between the liner and the well bore, which consists of the earth formation. This annular space can be filled with cement preventing axial flow along the casing. However if fluids need to enter or leave the well, small holes will be made penetrating the wall of the casing and the cement in the annulus therewith allowing fluid and pressure communication between the earth formation and the well. The holes are called perforations. This design is known in the Oil and natural gas industry as a cased hole completion.

An alternative way to allow fluid access from and to the earth formation can be made, a so called open hole completion. This means that the well does not have an annulus filled with cement but still has a liner installed in the earth formation. The latter design is used to prevent the collapse of the bore hole. Yet another design is when the earth formation is deemed not to collapse with time, then the well does not have a casing covering the earth formation where fluids are produced from. When used in horizontal wells, an uncased reservoir section may be installed in the last drilled part of the well. The well designs discussed here can be applied to vertical, horizontal and or deviated well trajectories.

To produce hydrocarbons from an oil or natural gas well, a method of water-flooding may be utilized. In water-flooding, wells may be drilled in a pattern which alternates between injector and producer wells. Water is injected into the injector wells, whereby oil in the production zone is displaced into the adjacent producer wells.

A horizontal, open hole completion well can comprise a main bore or a main bore with wanted side tracks (fishbone well) or a main bore with unwanted/unknown side tracks.

Further, a horizontal, open hole completion well may, when producing hydrocarbons (producer well) or when being injected with water (injector well) be larger than the original drilled size due to wear and tear.

Additionally, horizontal, open hole completion wells can have wash outs and/or cave ins.

Thus, a need exist to characterize open hole completion wells. The characterization may comprise e.g. measurement versus depth or time, or both, of one or more physical quantities in or around a well.

In order to determine such characteristics of an open hole completion, wireline logging may be utilized. Wire-line logging may comprise a tractor which is moved down the open hole completion during which data is logged e.g. by sensors on the tractor.

However, an open hole completion may comprise soft and/or poorly consolidated formations which may pose a problem for existing tractor technologies. For example, chain tracked tractors may impact the wall of soft and/or poorly consolidated formations with too large a force, and tractors comprising gripping mechanisms may rip of pieces of the soft and/or poorly open hole completion wall. A further problem of tractors comprising gripping mechanisms is the restriction in outer diameter, due to the drilled well, of the tractor which may restrict the length and mechanical properties of the gripping mechanisms.

A further problem of the existing tractor technologies with respect to e.g. horizontal open hole completion wells is that the open hole completion may have a diameter varying from the nominal inner diameter of 8.5 inch of the cased completion hole due to e.g. wash-outs and/or cave ins.

Thus, it may be advantageous to be able to move a tractor through an open hole completion well possibly containing soft and/or poorly consolidated formations.

Therefore, an object of the invention is to enable movement of a device through an open hole completion well possibly containing soft and/or poorly consolidated formations.

SUMMARY

The object of the invention is achieved by a device for moving in a tubular channel comprising a first part and a second part; wherein the first part comprises a reservoir (A) comprising a fluid and sealed from a pressure chamber comprising a fluid and a piston dividing the pressure chamber into a first (B) and a second piston pressure chamber (C) fluidly coupled via a pump; and wherein the second part is attached to the first part via a hollow tubular member extending from the reservoir (A) through the pressure chamber; and wherein the hollow tubular member is attached to the piston such that translation of the piston via a pressure difference between the first (B) and a second piston pressure chamber (C) established by the pump results in translation of the hollow tubular member and the second part.

In an embodiment the device further comprising a first gripping means attached to the first part and a second gripping part attached to the second part and wherein the two gripping means are fluidly coupled via the pump; wherein a first of the two gripping means comprises a fluid; wherein the pump is adapted to inflate a second of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

In an embodiment inflation of the second gripping means attached to the second part is performed by pumping the fluid from the first gripping means via the reservoir (A) and the hollow tubular member to the second gripping means.

By inflating the second gripping means via a the reservoir and the hollow tubular member, the invention may push the second part and pull the first part without risking breaking pipes or the like establishing fluid coupling between the pump and the second gripping means.

In an embodiment the device further comprises a pressure relief valve fluidly coupled to the pump to determine a maximal pressure pumped into the gripping means.

Thereby, the device is able to control the maximal pressure exerted on the walls of the open hole completion and therewith prevent damage to the walls because the pressure relief valve may be set to open before a pressure is reached at which damage to the walls is likely to occur.

In an embodiment the device further comprises at least one sensor communicatively coupled to a programmable logic controller contained in the device, and wherein the programmable logic controller calculates a control signal for controlling the pump based on data from the at least one sensor.

Thereby, the invention is able to adjust the pressure pumped into the gripping means according to the surroundings in the tubular channel because the PLC may adjust the pressure pumped into the gripping means according to the surrounding e.g. if the tubular channels narrows due to a cave-in, the PLC may reduce the pressure pumped into the gripping means at the location of the cave-in. Alternatively or additionally, the PLC may adjust the translation-length of the second part such that placement of a gripping means at the cave-in is avoided and thus that the gripping means are placed on either side of the cave-in.

In an embodiment the communicatively coupling is a BLUETOOTH® link.

In an embodiment the device further comprises an acoustic modem communicatively coupled to the programmable logic controller such that the programmable logic controller is adapted to transmit date received from the at least on sensor to a receiver at the entrance of the tubular channel.

In an embodiment the device further comprises at least one directional means comprising a lever attached at one end to an outer side of the device and activated by an actuator attached at one end to the outer side of the device and the other end to the lever.

In a further embodiment a device for moving in a tubular channel comprising two gripping means fluidly connected via a pump; wherein a first of the two gripping means comprises a fluid; wherein the pump is adapted to inflate a second of the gripping means by pumping the fluid from the first of the two gripping means to the second of the two gripping means; and wherein the gripping means comprises a flexible member contained in a woven member, wherein the flexible member provides fluid-tightness and the woven member provides the shape of the gripping means.

The gripping means comprising a flexible member contained in a woven member, which may be inflated, enables the device to exert a force to the wall of a tubular channel without ripping pieces of the wall.

Additionally, the woven member may provide a shape of the flexible member, so that the flexible member may not be over-stressed and/or deformed beyond it's allowable elastic range. Further, the woven member provides physical strength and wear resistance to the flexible member.

In an embodiment, the device further comprises a first part to which the first gripping means are attached and a second part to which the second gripping means are attached; wherein the first part comprises a reservoir comprising a fluid and sealed from a pressure chamber comprising a fluid and a piston dividing the pressure chamber into a first and a second piston pressure chamber fluidly coupled via a pump; and wherein the second part is attached to the first part via a hollow tubular member extending from the reservoir through the pressure chamber; and wherein the hollow tubular member is attached to the piston such that translation of the piston via a pressure difference between the first (B) and a second piston pressure chamber (C) established by the pump results in translation of the hollow tubular member and the second part.

Thereby, the device is able to move forward in the tubular channel without restricting the length and mechanical properties of the gripping means because the translation is performed along the longitudinal axis of the device and the gripping means are flexible.

The object of the invention is further achieved by a method of moving a device in a tubular channel, the device comprising a first gripping means attached to a first part comprising a reservoir (A) comprising a fluid and sealed from a pressure chamber comprising a fluid and a piston dividing the pressure chamber into a first (B) and a second piston pressure chamber (C) fluidly coupled via a pump; and a second gripping means (G2) attached to a second part, wherein the second part is attached to the first part via a hollow tubular member; the method comprises repeating: inflating the first gripping means by pumping a fluid from the second gripping means to the first gripping means; pushing the second part from the first part by pressurizing the first piston pressure chamber (B) and depressurizing the second piston pressure chamber (C); inflating the second gripping means by pumping the fluid from the first gripping means to the second gripping means; and pulling the first part to the second part by pressurizing the second piston pressure chamber (C) and depressurizing the first piston pressure chamber (B).

Further the object of the invention is achieved by a system for moving in a tubular channel, the system comprising a tubular channel and a device according to the described embodiments.

In an embodiment of the system the tubular channel is a borehole comprising petroleum oil hydrocarbons in fluid form.

Further embodiments and advantages are disclosed below in the description and in the claims.

BRIEF DESCRIPTION OF THE DRAWINGS

The invention will now be described more fully below with reference to the drawings, in which.

DETAILED DESCRIPTION

Figure 1:
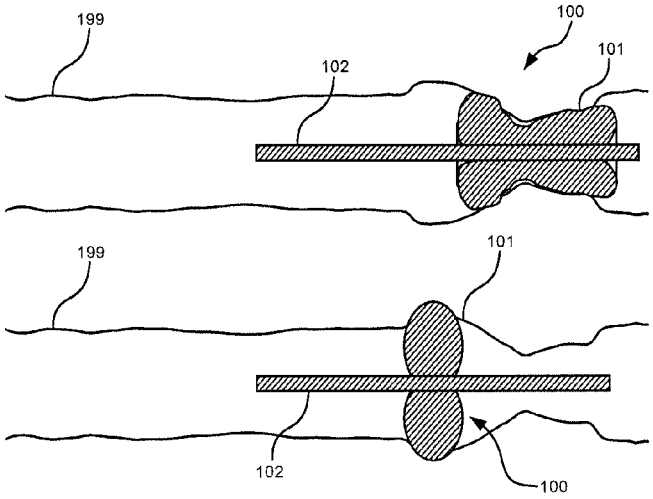
FIG. 1 shows a sectional view of a device 100 for moving in a tubular channel 199.

FIG. 1 shows a sectional view of a device 100 for moving in a tubular channel 199. Below and above, a tubular channel may be exemplified by a borehole, a pipe, a fluid-filled conduit, and an oil-pipe.

The tubular channel 199 may contain a fluid such as hydrocarbons, e.g. petroleum oil hydrocarbons such as paraffins, naphthenes, aromatics and asphaltics.

The device 100 comprises inflatable and deflatable gripping means 101. The inflatable and deflatable gripping means 101 may, for example, be flexible bellows which may adapt to the wall condition of the tubular channel 199. The gripping force exerted by the device 100 on the tubular channel wall 199 depends on the pressure of the flexible bellows 101 on the tubular channel wall 199. The device 100 further comprises a part 102 to which the inflatable and deflatable gripping means 101 may be fastened and which may be at least partially encased by the inflatable and deflatable gripping means 101. For example, the part 102 may be rod-shaped and the inflatable and deflatable gripping means 101 may be shaped as a tubeless tire and thus, when fastened to the rod-shaped part 102 e.g. via glue or the like, encase a part of the rod-shaped part 102.

Figure 2:
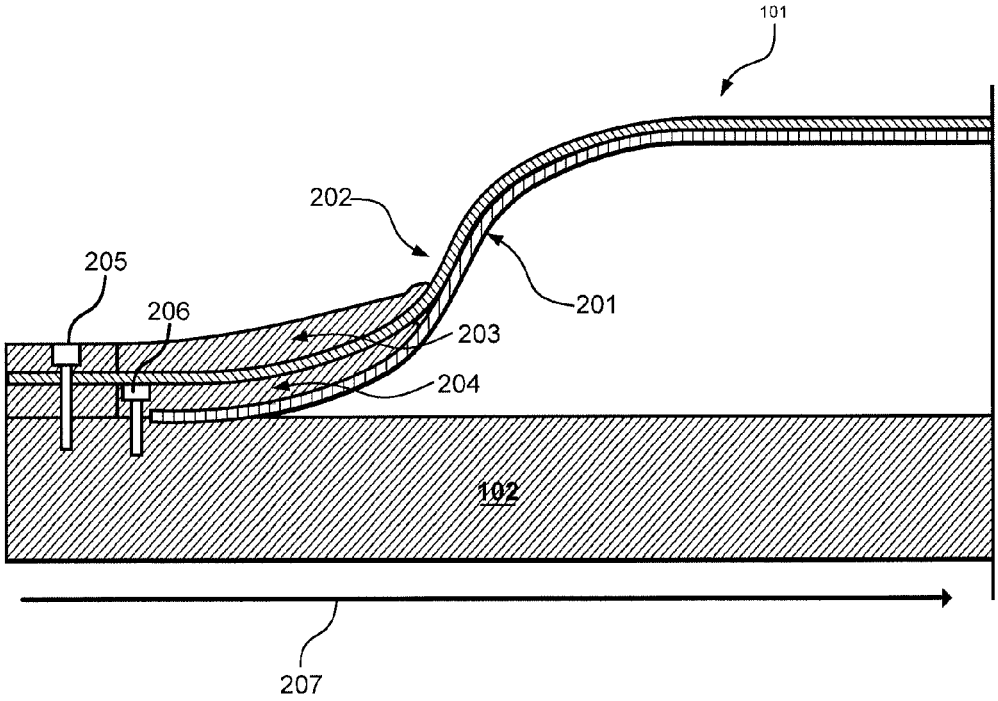
FIG. 2 shows a sectional view of a inflatable and deflatable gripping means 101.

FIG. 2 shows a sectional view of the inflatable and deflatable gripping means 101. The flexible bellows 101 may comprise a woven texture bellow 202, e.g. made of woven aramid and/or Kevlar, and a pressure-tight flexible bellow 201, e.g. made of a rubber or other flexible and air-tight/pressure-tight/fluid-tight material. The pressure-tight flexible bellow 201 is encased by the woven texture 202. The flexible pressure-tight bellow 201 provides the pressure integrity of the inflatable and deflatable gripping means 101.

The pressure-tight flexible bellow 201 may be clamped to the part 102 by a first curved, e.g. parabolic-shaped, ring 204 providing a gradual clamping force along the horizontal axis 207 of the part 102, whereby pinching and subsequent rupture of the pressure-tight flexible bellow 201 due to an internal pressure of the pressure-tight flexible bellow 201 may be prevented. The first curved ring 204 may be clamped to the part 102 by a fastening means 206 such as a screw, nail or the like. The first curved ring 204 must be pressure tight i.e. must provide sealing of the pressure-tight flexible bellow 201 to the part 102 but may have any clamping strength.

The woven texture bellow 202 may be clamped between the first curved ring 204 and a second curved, e.g. parabolic-shaped, ring 203. The first and the second curved rings thus provide a gradual clamping force along the horizontal axis 207 of the part 102, whereby pinching and wear of the woven texture bellow 202 may be prevented. The second curved ring 203 may be clamped to the part 102 by a fastening means 205 such as a screw, nail or the like. The second curved ring 203 may be positioned on top of the first curved ring 204 as illustrated in FIG. 2. The second curved ring 202 must be strong in order to maintain the shape of the woven texture, but may provide any pressure tightness i.e. it is not required to be pressure-tight.

The woven texture bellow 202 may provide a shape of the pressure-tight flexible bellow 201, so that the pressure-tight flexible bellow 201 may not be over-stressed and/or deformed beyond it's allowable elastic range. Further, the woven texture bellow 202 provide physical strength and wear resistance to the pressure-tight flexible bellow 201.

The curved rings may further provide shape stability of the inflatable and deflatable gripping means 101. Further, the curved rings may prohibit sharp edges such that multiple inflations/deflations of the inflatable and deflatable gripping means 101 can be achieved.

In an embodiment, the woven texture 202 may be covered with ceramic particles in order to provide wear resistance of the woven texture 202.

Figure 3:
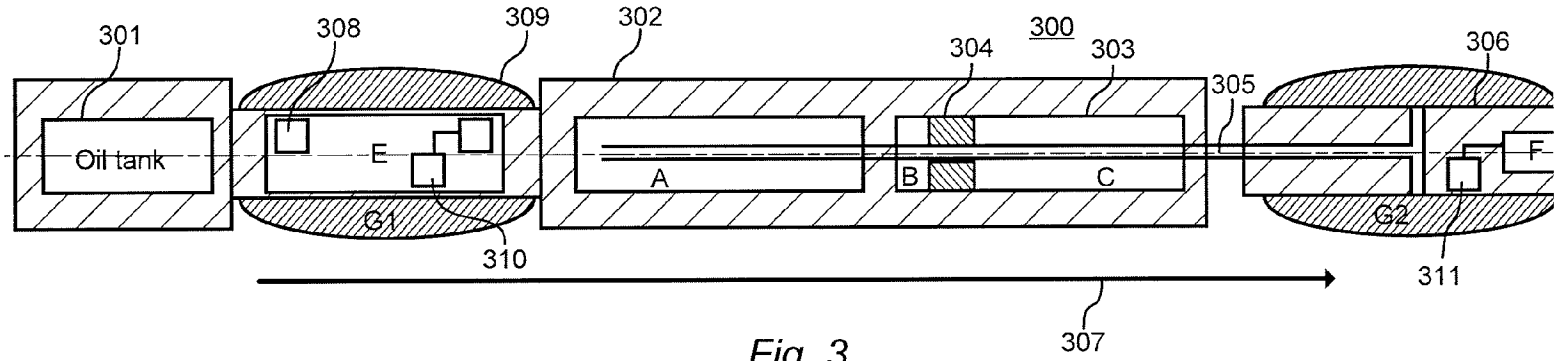
FIG. 3 shows a sectional view of an embodiment of a device 100 for moving in a tubular channel 199 comprising two inflatable and deflatable gripping means, G1, G2.

FIG. 3 shows a sectional view of an embodiment of a device 100 for moving in a tubular channel 199 comprising two inflatable and deflatable gripping means, G1, G2. The device 100 comprises a hydrophore 301 attached to a pump section E comprising a pumping unit 308 and a programmable logic controller (PLC) 309.

The hydrophore 301 may, for example, be a rubber bellow encased or substantially encased in a steel cylinder. The hydrophore 301 may contain oil (or any other pumpable fluid). The hydrophore prevents the oil from bursting out e.g. when the pressure changes and/or when the temperature changes. For example, the temperature at the entrance of the tubular channel 199 may be at −10 degrees C. and in the tubular channel 199 the temperature may be 100 degrees C. Additionally for example, the pressure at the entrance of the tubular channel 199 may be 1 bar and in the tubular channel 199 the pressure may be 250 bar.

The pump section E may further comprise a battery providing power to the device 100. Alternatively or additionally, the device 100 may comprise a plug/socket for receiving a wireline, through which the device 100 may be powered. For example, the plug/socket may be located on the oil tank 301 e.g. on the end facing away from the pump section E.

The pumping unit 308 may, for example, comprise a fixed displacement bidirectional hydraulic pump.

The PLC 309 may be communicatively coupled, e.g. via an electric wire, to a short-range radio unit 310, e.g. a BLUETOOTH® unit.

Further attached to and partly or wholly encasing the pump section E is a first inflatable and deflatable gripping means G1. The first inflatable and deflatable gripping means G1 may be of the type disclosed under FIG. 2. The first inflatable and deflatable gripping means G1 may comprise a fluid such as an oil or the like which may be pumped by the pumping unit 308.

Further attached to the pump section E is a cylinder section 302. The cylinder section 302 comprises a reservoir A, e.g. an oil reservoir, and a pressure chamber 303 comprising a first piston pressure chamber B and a second piston pressure chamber C.

The cylinder section 302 further comprises a piston 304 attached to a connecting rod 305. A first end of the connecting rod 305 is located in the oil reservoir A and the other end of the connecting rod 305 is attached to a sensor section 306. The sensor section 306 is thus attached to the device 100 via the connection rod 305. The connection rod 305 may translate along the longitudinal axis 307 of the device 100. The connecting rod 305 may be hollow i.e. enabling e.g. a fluid to pass through it. The piston 304 is located in the pressure chamber 303.

The oil reservoir and the first piston pressure chamber B and the second piston pressure chamber C may comprise a pumpable fluid, such as an oil or the like, which may be pumped by the pumping unit 308. The oil reservoir A may be sealed from the pressure chamber 303.

Attached to and partly or wholly encasing the sensor section 306 is a second inflatable and deflatable gripping means G2. The second inflatable and deflatable gripping means G2 may be of the type disclosed under FIG. 2. The second inflatable and deflatable gripping means G2 may comprise a fluid such as an oil or the like which may be pumped by the pumping unit 308.

Further, the sensor section 306 may comprise a number of sensors F. For example, the sensor section 306 may contain a number of ultrasonic sensors for determining the relative fluid velocity around the sensor section 306. An ultrasonic sensor may be represented by a transducer. The ultrasonic sensors may be contained within the sensor section 306. The ultrasonic sensors may provide data representing a fluid velocity.

Additionally, the sensor section 306 may, for example, include a number of distance sensors. The number of ultrasonic distance sensors may provide data representing a distance to e.g. the surrounding tubular channel 199. The ultrasonic distance sensors may be contained within the sensor section 306. The ultrasonic distance sensors may provide data representing a distance between the sensor section 306 and the surrounding tubular channel 199 i.e. data representing a radial view. Further, the ultrasonic distance sensors may provide data representing a distance between the sensor section 306 and e.g. potential obstacles, such as cave-ins/wash-outs, in front of the device 100 i.e. data representing a forward view.

The ultrasonic sensors and ultrasonic distance sensors of the sensor section 306 may be probing the fluid surrounding the device 100 and the tubular channel 199 through e.g. glass windows such that the sensors are protected against the fluid flowing in the tubular channel 199.

The sensor section 306 may additionally comprise a pressure sensor. The pressure sensor may be contained in the sensor section 306. The pressure sensor may provide data representing a pressure of a fluid surrounding the device 100.

Further, the sensor section 306 may contain an resistivity meter for measuring the resistivity of the fluid surrounding the device 100. The resistivity meter may be contained in the sensor section 306. The resistivity meter may provide data representing resistivity of the fluid surrounding the device 100.

Further, the sensor section 306 may contain a temperature sensor for measuring the temperature of the fluid surrounding the device 100. The temperature sensor may be contained in the sensor section 306. The temperature sensor may provide data representing a temperature of the fluid surrounding the device 100.

The sensor section 306 may additionally comprise a position-determining unit providing data representing the position of the device 100, and thus enabling position tagging of the data from the abovementioned sensors. The position tagging may, for example, be performed with respect to e.g. the entrance of the tubular channel 199.

In an embodiment, the position-determining unit may comprise a plurality of gyroscopes, for example three gyroscopes (one for each three dimensional axis), and a compass and a plurality of accelerometers, for example three accelerometers (one for each three dimensional axis), and a tiltmeter (inclinometer).

The sensor section 306 may further contain a short-range radio unit 311, such as a BLUETOOTH® unit, capable of establishing a short-range radio link to the PLC 309. Further, the short-range radio unit may be communicatively coupled, e.g. via an electric wire, to one or more of the abovementioned sensors and thereby the sensor section 306 is enabled to transmit data from the one or more sensors F to the PLC 309 via the short-range radio link.

The PLC 309 may be communicatively coupled, e.g. via electric wires, to the pumping unit 308 whereby the PLC is able to control the pumping unit 308 e.g. by transmitting a control signal to the pump 400 of the pumping unit 308.

Figure 4:
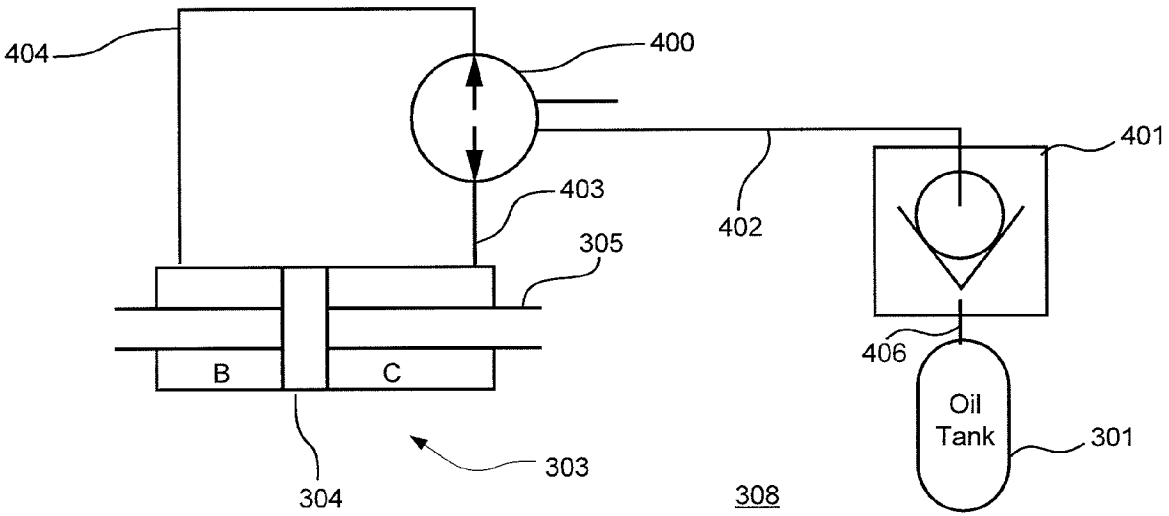
FIG. 4 shows a schematic diagram of an embodiment of a pumping unit 308 adapted to translate the connecting rod 305.

FIG. 4 shows a schematic diagram of an embodiment of a pumping unit 308 adapted to translate the connecting rod 305. The pumping unit of FIG. 4 may be contained in a device such as disclosed with respect to FIGS. 3 and/or 6 and/or 8.

The pumping unit 308 comprises the pump 400 of the pump section E. Further, the pumping unit 308 comprises a back-flow valve 401 and the oil tank 301. The pump 400, e.g. a low pressure pump, is fluidly coupled, e.g. via a pipe 402, to the back-flow valve 401, and via the valve 401 and a pipe 402 to the oil tank 301. Additionally, the pump 400 is fluidly coupled, e.g. via a pipe 403, to the second piston pressure chamber C and, e.g. via a pipe 404, to the first piston pressure chamber B of the pressure chamber 303.

The pumping unit 308 is able to, e.g. in response to a control signal from the PLC 309, translate the piston 304 and thereby the connecting rod 305 along the longitudinal axis 307 of the device 100.

For example, to translate the piston 304 towards the first piston pressure chamber B i.e. to the left in FIG. 4, the PLC 309 may transmit a control signal to the pump 400 such that the pump 400 starts to pump the fluid from the first piston pressure chamber B to the second piston pressure chamber C via the pipe 404. Thereby, the first piston pressure chamber B is depressurized and the second piston pressure chamber C is pressurized and thereby, the piston moves towards the first piston pressure chamber B.

For example, to translate the piston 304 towards the second piston pressure chamber C i.e. to the right in FIG. 4, the PLC 309 may transmit a control signal to the pump 400 such that the pump 400 starts to pump the fluid from the second piston pressure chamber C to the first piston pressure chamber B via the pipe 404. Thereby, the second piston pressure chamber C is depressurized and the first piston pressure chamber B is pressurized and thereby, the piston moves towards the second piston pressure chamber C.

The PLC 309 may transmit a further control signal to the pump 400 in order to stop the pump 400 when the piston 304, and thereby also the connecting rod 305, has been translated a distance determined by the PLC based on the data received from the one or more sensors. Alternatively or additionally, the pump 400 may receive a stop signal from the PLC 309 when the piston 304 reaches an end wall of the pressure chamber 303 e.g. by having a switch, e.g. a pushbutton switch, attached to the inside of each of the end walls of the pressure chamber 303 detecting when the piston 304 touches one of the end walls. The switches may be communicatively coupled, e.g. via electric wires, to the PLC 309.

Figure 5:
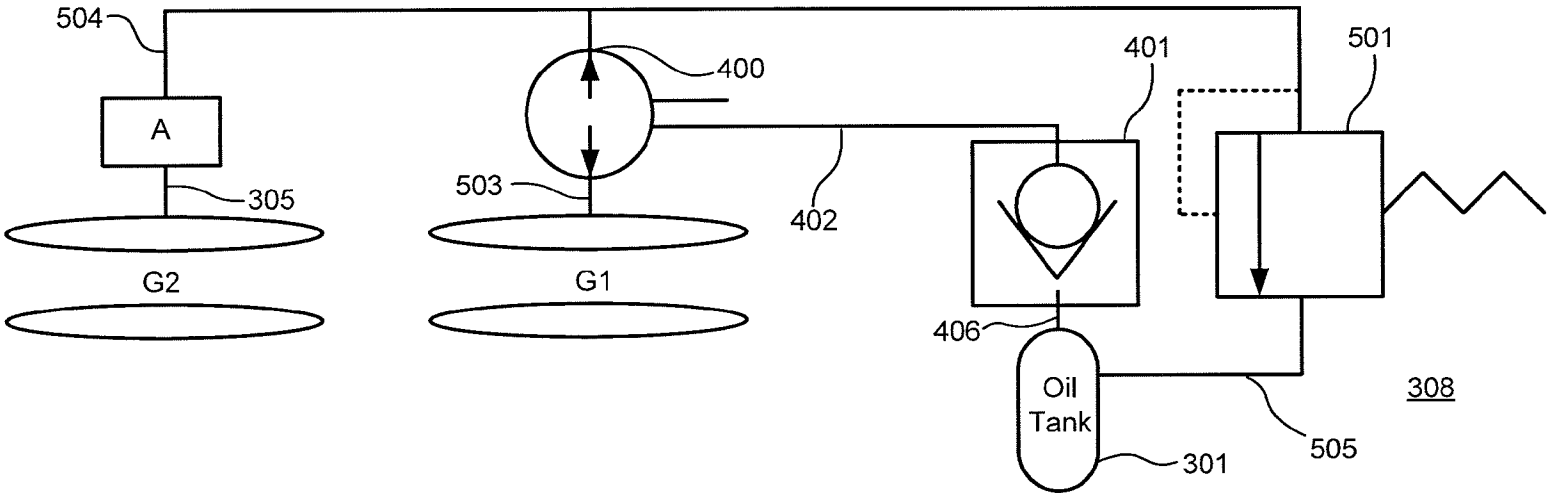
FIG. 5 shows a schematic diagram of an embodiment of a pumping unit 308 adapted to inflate and/or deflate the first and second inflatable and deflatable gripping means G1, G2.

FIG. 5 shows a schematic diagram of an embodiment of a pumping unit 308 adapted to inflate and/or deflate the first and second inflatable and deflatable gripping means G1, G2. The pumping unit of FIG. 5 may be contained in a device such as disclosed with respect to FIGS. 3 and/or 6 and/or 8.

The pumping unit 308 comprises the pump 400 of the pump section E. Further, the pumping unit 308 comprises the back-flow valve 401 and the oil tank 301. Further, the pumping unit 308 may comprise a pressure-relief valve 501, the oil reservoir, the connecting rod 305 and the first and second inflatable and deflatable gripping means G1, G2.

The pressure-relief valve 501 may, for example, determine the pressure in the pumping unit 308.

The pump 400, e.g. a low pressure pump, is fluidly coupled, e.g. via a pipe 402, to the back-flow valve 401, and via the valve 401 and a pipe 406 to the oil tank 301.

Additionally, the pump 400 is fluidly coupled, e.g. via a pipe 503, to the first inflatable and deflatable gripping means G1 and, e.g. via a pipe 504, to the second inflatable and deflatable gripping means G2. The pipe 504 may further fluidly couple the pump 400 to the pressure-relief valve 501. The pressure-relief valve 501 may be fluidly coupled via e.g. a pipe 505 to the oil tank 301.

The pumping unit 308 is able to, e.g. in response to a control signal from the PLC 309, inflate one of the inflatable and deflatable gripping means while deflating the other.

For example, to inflate the first inflatable and deflatable gripping means G1, the PLC 309 may transmit a control signal to the pump 400 such that the pump 400 starts to pump the fluid from second inflatable and deflatable gripping means G2 to the first inflatable and deflatable gripping means G1 via the connecting rod 305, the oil reservoir A and the pipe 504. Thereby, the second inflatable and deflatable gripping means G2 deflates while the first inflatable and deflatable gripping means G1 inflates.

For example, to inflate the second inflatable and deflatable gripping means G2, the PLC 309 may transmit a control signal to the pump 400 such that the pump 400 starts to pump the fluid from first inflatable and deflatable gripping means G1 to the second inflatable and deflatable gripping means G2 via the pipe 504, the oil reservoir A and the connecting rod 305. Thereby, the first inflatable and deflatable gripping means G1 deflates while the second inflatable and deflatable gripping means G2 inflates.

The PLC 309 may transmit a further control signal to the pump 400 in order to stop the pump 400 when the inflatable and deflatable gripping means being inflated has a volume providing a sufficient grip on the tubular channel wall. The sufficient grip on the tubular channel may, for example, be determined by the pressure relief valve 501 i.e. as long as the valve is close, the pump 400 pumps from one inflatable and deflatable gripping means to the other inflatable and deflatable gripping means. Once the pressure-relief valve 501 opens, the pump pumps from the deflating inflatable and deflatable gripping means to the oil tank via the pressure relief valve 501.

The pressure relief valve 501 may be communicatively coupled to the PLC 309 e.g. via a wire. Once the pressure relief valve 501 opens, it may transmit a control signal to the PLC 309 which subsequently transmits a control signal to the pump 400 stopping the pump 400. Once the pressure in the pumping unit 500 reaches the pressure relief valve's reseating pressure, the pressure relief valve closes again.

Figure 6A:
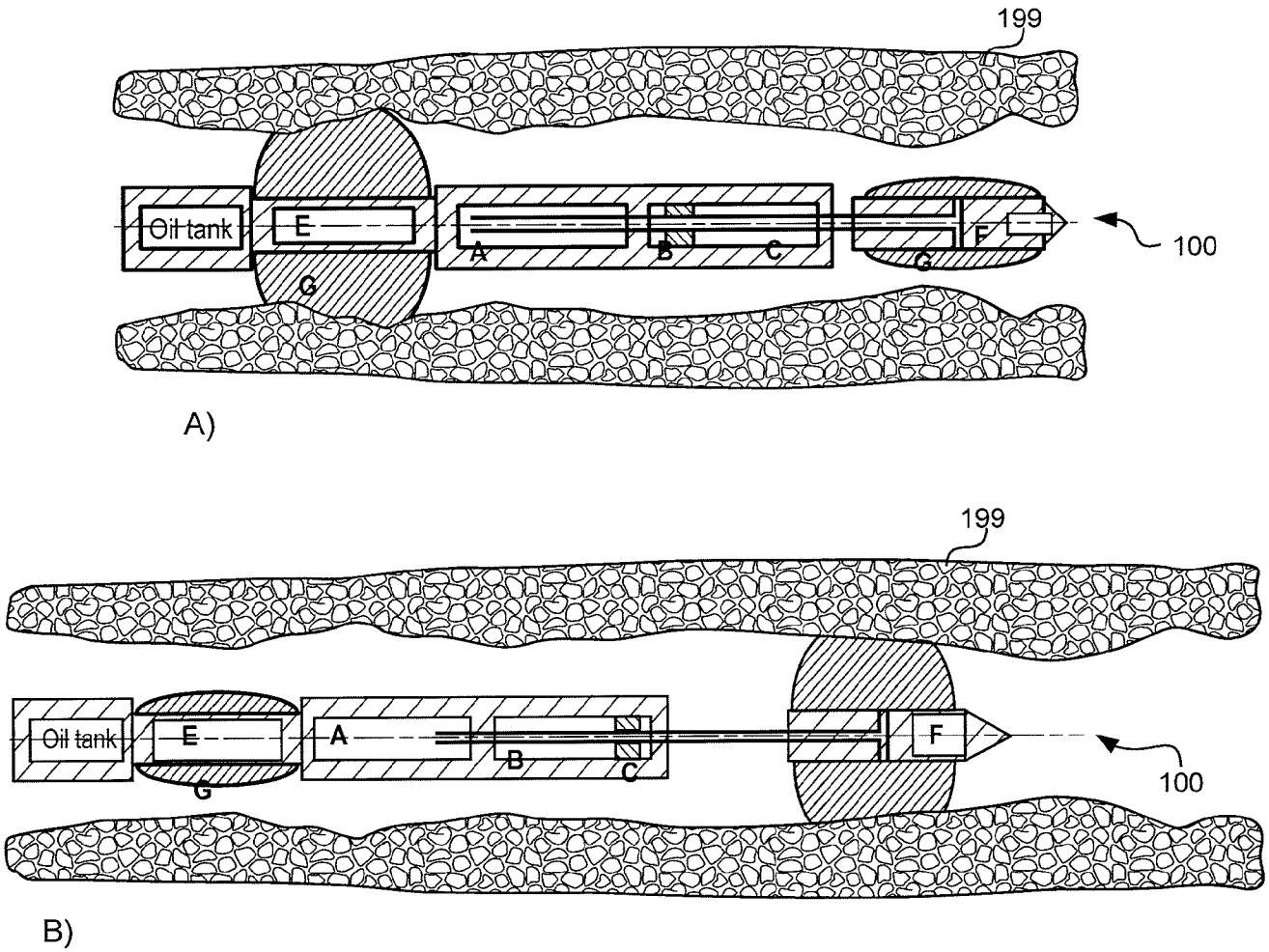
FIGS. 6*a* and 6*b* show a method of moving the device 100 in a tubular channel 199.
Figure 6B:
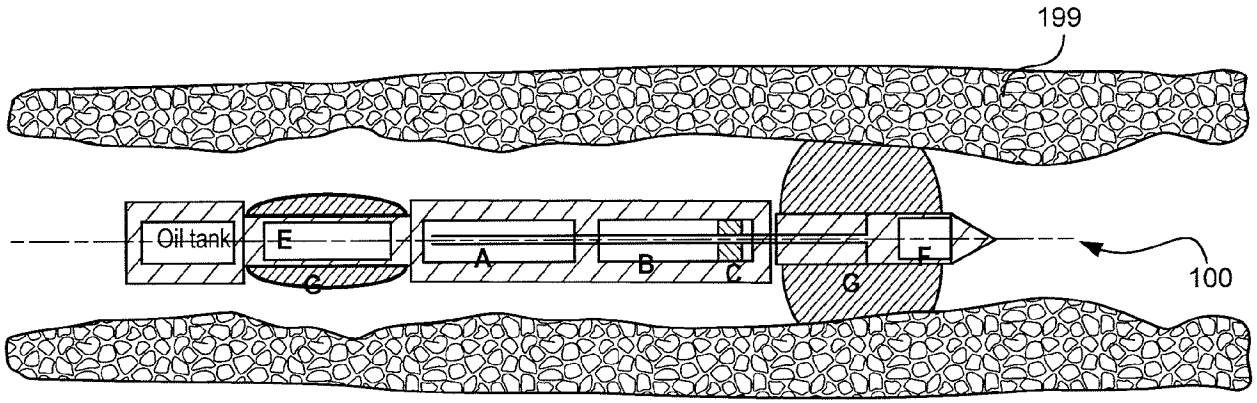
Figure 6B:
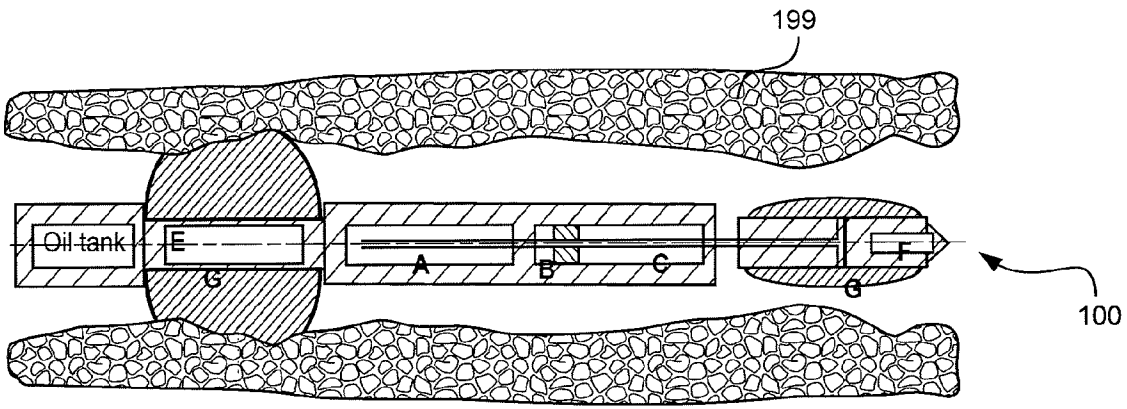

FIG. 6 shows a method of moving the device 100 in a tubular channel 199.

Figure 7:
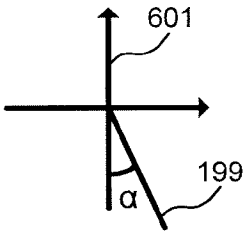
FIG. 7 shows the angle between the tubular channel and vertical.

In a first step, the device 100, e.g. containing a load such as a patch or the like, may be moved into the tubular channel by a wireline lubricator. The device 100 may be moved in such a way as long as the angle $\alpha$, as shown in FIG. 7, between the tubular channel 199 and vertical 601 is smaller than 60 degrees. When the angle $\alpha$ becomes equal to or larger than 60 degrees, the friction between the device 100 and the tubular channel 199 and/or the fluid in the tubular channel 199 may be larger than the gravitational pull in the device 100 thus preventing the device 100 from moving further in this way. When moving the device 100 via a wireline lubricator, both the first and the second inflatable and deflatable gripping means G1, G2 may be deflated in order to ease movement of the device 100 through the tubular channel 199.

Thus, in a second step, the device is powered up comprising starting the sensors F in the sensor section 306. The power-up may further comprise a test of all the sensors and communication between the short-range radio units 310 and 311.

In a third step as illustrated in FIG. 6A), the first inflatable and deflatable gripping means G1 are inflated. In the case where the device 100 has just powered up, both inflatable and deflatable gripping means G1, G2 are deflated and therefore, the inflation is performed by pumping fluid from the oil tank 301 via pipe 406, back flow valve 401, pipe pump 308, and pipe 503 into inflatable and deflatable gripping means G1.

In a fourth step, the sensor section 306 is translated (pushed) to the right by pressurizing the first piston pressure chamber B and depressurizing the second piston pressure chamber C as disclosed above with respect to FIG. 4.

In a fifth step as illustrated in FIG. 6B), the second inflatable and deflatable gripping means G2 are inflated and the first inflatable and deflatable gripping means G1 are deflated as disclosed above with respect to FIG. 5.

In a sixth step as illustrated in FIG. 6C), the oil tank 301, the pump section E and the cylinder section 302 are translated (pulled) to the right by pressurizing the second piston pressure chamber C and depressurizing the first piston pressure chamber B as disclosed above with respect to FIG. 4.

In a seventh step as illustrated in FIG. 6D), the first inflatable and deflatable gripping means G1 are inflated and the second inflatable and deflatable gripping means G2 are deflated as disclosed above with respect to FIG. 5.

The above steps, step seven, step four, step five and step six, provides a method of moving the device 100 in a tubular channel 199 once one of the inflatable and deflatable gripping means G1, G2 have been inflated.

In an embodiment, the device 100 may move in reverse of the above described direction. In the event where the device 100 is powered through and/or connected to a wireline, the wireline must be pulled out of the tubular channel 199 at the same velocity or approximately the same velocity (e.g. within 1%) as the device 100 moves through the tubular channel 199.

In an embodiment, the hydrophore 301, the pump section E, the cylinder section 302 and the sensor section may have a cylindrical cross section. For example, the device 100 with deflated inflatable and deflatable gripping means G1, G2 may have a diameter of approximately 4 inches (approximately 101.6 mm).

In an embodiment, based on the data received by the PLC 309 from the sensor section 306, e.g. from the ultrasonic distance sensors, the PLC 309 may determine by calculation whether the tubular channel 199 in front of the device 100 allows for moving the device 100 further into the tubular channel 199. Alternatively or additionally, based on the data received by the PLC 309 from the sensor section 306, e.g. from the ultrasonic distance sensors, the PLC 309 may determine the direction in which the device 100 is moving e.g. in the case of side tracks or the like in the tubular channel 199. Thereby, the PLC may calculate a control signal for controlling the device 100 based on the data received from one or more of the sensors F.

In an embodiment, the device 100 may further comprise an acoustic modem enabling the device 100 to transmit data received from one or more of the sensors F to a computer or the like equipped with an acoustic modem and positioned at the entrance of the tubular channel 199.

In an embodiment, the device 100 comprises two pumps, one for the pumping unit of FIG. 4 and one for the pumping unit of FIG. 5. Alternatively, the device 100 may comprise a single pump which through valves serves the pumping unit of FIG. 4 and the pumping unit of FIG. 5.

FIG. 8 shows a sectional view of an embodiment of a device 100 for moving in a tubular channel 199 comprising directional means H. The device 100 may comprise the technical features disclosed with respect to FIGS. 2 and/or 3 and/or 4 and/or 5. The directional means H may enable a steering of the device 100 e.g. a change in orientation of the device 100 with respect to a longitudinal axis of the tubular channel 199 e.g. in order to move the device into a sidetrack of a fishbone well or the like.

Figures 8A, 8B:
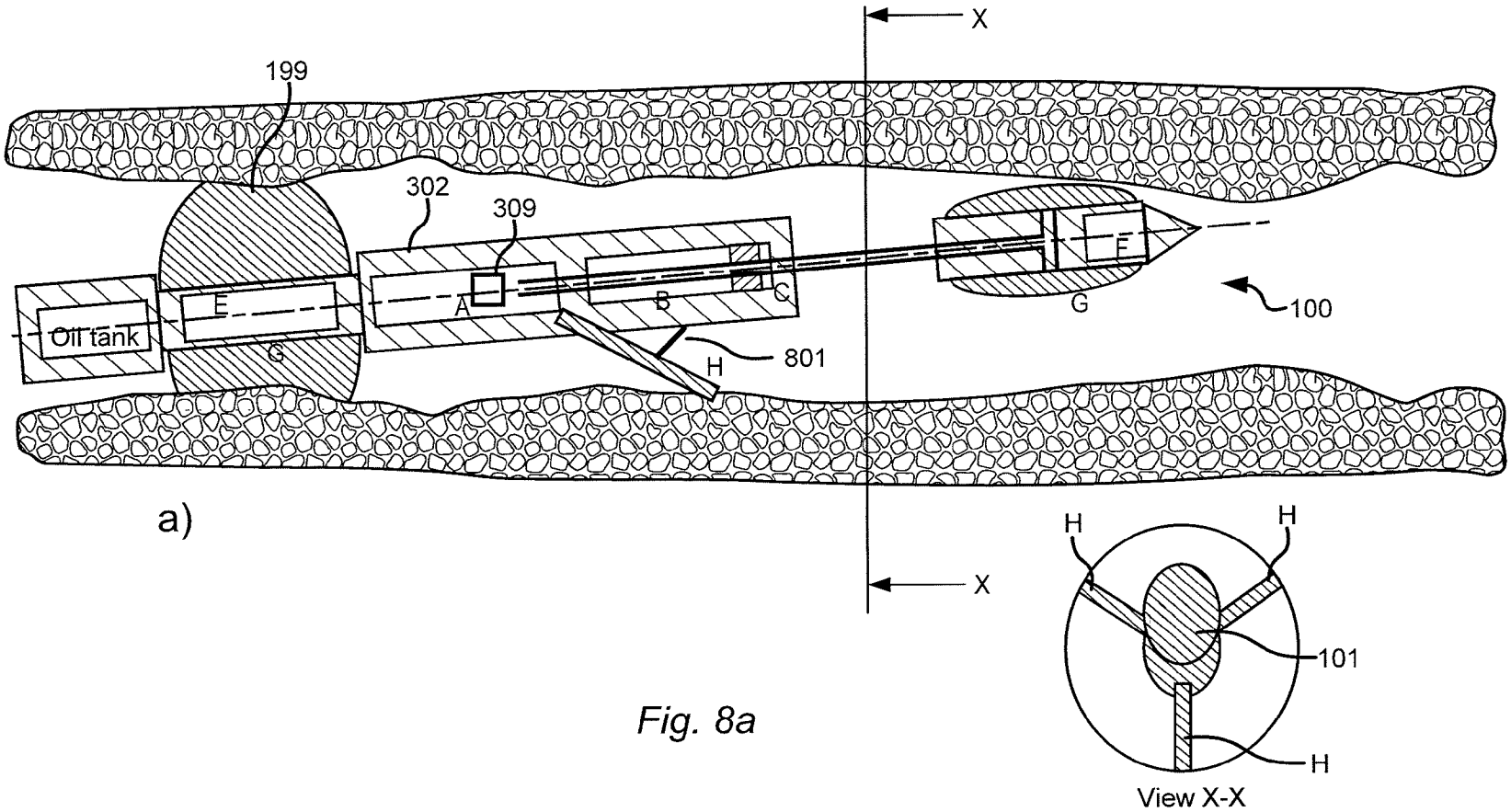
FIGS. 8*a* and 8*b* show a sectional views of an embodiment of a device for moving in a tubular channel comprising directional means.

As seen in FIG. 8*a*), the directional means H may, for example, comprise a cylindrical element e.g. a rod or the like. A first end of the cylindrical element may be attached to the cylinder section 302 via a ball bearing or a ball joint or a hinge or the like. The cylindrical element may act as a lever and may be connected to an actuator 801 which may extend the other end of the lever in a direction radially outwards from the cylinder section 302. The length of the directional means H may, for example, be approximately equal to the diameter of the tubular channel 199 e.g. approximately 8.5 inch±5%.

The actuator 801 may be electrically coupled, e.g. via an electric wire, to the PLC 309 enabling activation of the actuator via a control signal from the PLC 309.

In an embodiment as seen in FIG. 8*b*), the directional means may comprise three cylindrical elements H e.g. placed at a 120 degree separation along the circumference of the outer wall of the cylindrical section 302 of the device 100. Each of the cylindrical elements H may act as a lever attached at one end to the cylinder section and connected to an actuator 801 able of extending the other end of the cylindrical element H radially outwards from the cylinder section 302.

In an embodiment, the directional means H may comprise an inflatable bellow in order to prevent damaging the tubular channel 199 when actuating the directional means H. The inflatable bellow may for example be inflated when the directional means H are actuated thereby creating an inflated bellow around the directional means H.

In an embodiment, the PLC 309 may received data, on which the control signal is calculated, from the sensors in the sensor section F. Alternatively, the PLC 309 may receive a control signal via a wireline from the entrance of the tubular channel 199.

Generally, in the above and the below, the inflatable and deflatable gripping means G1, G2, G of the devices disclosed with respect to FIGS. 1 and/or 3 and/or 6 and/or 8 may be of the type disclosed with respect to FIG. 2.

In an embodiment, the device 100 may comprise at least one fluid passage for equalizing the pressure on both sides of said at least one fluid passage. For example, the at least one fluid passage may comprise a hole along the longitudinal axis of the device 100 in a first of the inflatable and deflatable gripping means G1 thereby equalizing the pressure on both sides of the inflatable and deflateable gripping means G1. In an embodiment comprising two inflatable and deflatable gripping means G1, G2, the device may additionally comprise a fluid passage, e.g. a hole along the longitudinal axis of the device 100, in a second of the inflatable and deflatable gripping means G2 thereby equalizing the pressure on both sides of device 100.

In general, any of the technical features and/or embodiments described above and/or below may be combined into one embodiment. Alternatively or additionally any of the technical features and/or embodiments described above and/or below may be in separate embodiments. Alternatively or additionally any of the technical features and/or embodiments described above and/or below may be combined with any number of other technical features and/or embodiments described above and/or below to yield any number of embodiments.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A device for moving in a tubular channel comprising:

a first part comprising:

a reservoir that includes a fluid; and a pressure chamber sealed from the reservoir, the pressure chamber includes a fluid and a piston that divides the pressure chamber into a first chamber portion and a second chamber portion, the first and second chamber portions being fluidly coupled to one another via a pump;

a hollow tubular member with a first end disposed in the reservoir, the hollow tubular member extends from the reservoir through the pressure chamber to a second end disposed outside of the first part, wherein the hollow tubular member is attached to the piston such that translation of the piston via a pressure difference between the first and the second chamber portions established by the pump results in translation of the hollow tubular member; and a second part attached to the second end of the hollow tubular member such that the second part moves with the hollow tubular member during translation;

a first gripping device attached to the first part and a second gripping device attached to the second part, wherein each gripping device comprises a flexible member disposed within a woven member and is configured to expand when filled with a fluid to cause the gripping device to contact the tubular channel, wherein the flexible member provides fluid-tightness and the woven member provides the shape of the gripping devices; and wherein a first of the two gripping devices comprises a fluid and the pump fluidly couples the two gripping devices and is configured to pump the fluid from one of the two gripping devices to the other of the two gripping devices to thereby inflate the other gripping device.

2. The device according to claim 1, wherein inflation of the second gripping device attached to the second part is performed by pumping the fluid from the first gripping device via the reservoir and the hollow tubular member to the second gripping device.

3. The device according to claim 2, wherein the device further comprises a pressure relief valve fluidly coupled to relieve pressure produced by the pump and thereby limit a pressure of the fluid pumped into the gripping devices.

4. The device according to anyone of claim 2, wherein the device further comprises at least one sensor communicatively coupled to a programmable logic controller contained in the device, and wherein the programmable logic controller calculates a control signal for controlling the pump based on data from the at least one sensor.

5. The device according to anyone of claim 2, further comprising at least one directional means comprising a lever attached at one end to an outer side of the device and activated by an actuator attached at one end to the outer side of the device and the other end to the lever.

6. A system for moving in a tubular channel, the system comprising a tubular channel and a device according to anyone of claim 2.

7. The device according to claim 1, wherein the device further comprises a pressure relief valve fluidly coupled to the pump to relieve pressure produced by the pump and thereby limit a pressure of the fluid pumped into the gripping devices.

8. The device according to anyone of claim 7, wherein the device further comprises at least one sensor communicatively coupled to a programmable logic controller contained in the device, and wherein the programmable logic controller calculates a control signal for controlling the pump based on data from the at least one sensor.

9. The device according to anyone of claim 7, further comprising at least one directional means comprising a lever attached at one end to an outer side of the device and activated by an actuator attached at one end to the outer side of the device and the other end to the lever.

10. The device according to anyone of claim 1, wherein the device further comprises at least one sensor communicatively coupled to a programmable logic controller contained in the device, and wherein the programmable logic controller calculates a control signal for controlling the pump based on data from the at least one sensor.

11. The device according to claim 10, wherein communications between the at least one sensor and the programmable logic controller conform to a protocol promulgated by the BLUETOOTH® standards working group.

12. The device according to claim 11, wherein the device further comprises an acoustic modem communicatively coupled to the programmable logic controller such that the programmable logic controller is adapted to transmit date received from the at least on sensor to a receiver at the entrance of the tubular channel.

13. The device according to anyone of claim 11, further comprising at least one directional means comprising a lever attached at one end to an outer side of the device and activated by an actuator attached at one end to the outer side of the device and the other end to the lever.

14. The device according to claim 10, wherein the device further comprises an acoustic modem communicatively coupled to the programmable logic controller such that the programmable logic controller is adapted to transmit data received from the at least on sensor to a receiver at the entrance of the tubular channel.

15. The device according to anyone of claim 14, further comprising at least one directional means comprising a lever attached at one end to an outer side of the device and activated by an actuator attached at one end to the outer side of the device and the other end to the lever.

16. The device according to anyone of claim 10, further comprising at least one directional means comprising a lever attached at one end to an outer side of the device and activated by an actuator attached at one end to the outer side of the device and the other end to the lever.

17. The device according to anyone of claim 1, further comprising at least one directional means comprising a lever attached at one end to an outer side of the device and activated by an actuator attached at one end to the outer side of the device and the other end to the lever.

18. A system for moving in a tubular channel, the system comprising a tubular channel and a device according to anyone of claim 1.

19. The system according to claim 18, wherein the tubular channel is a borehole comprising petroleum oil hydrocarbons in fluid form.

20. A method of moving a device in a tubular channel, the method comprising:

providing a device that comprises:

a first part comprising:

a reservoir that includes a fluid; and a pressure chamber sealed from the reservoir, the pressure chamber includes a fluid and a piston that divides the pressure chamber into a first chamber portion and a second chamber portion, the first and second chamber portions being fluidly coupled to one another via a pump;

a hollow tubular member with a first end disposed in the reservoir, the hollow tubular member extends from the reservoir through the pressure chamber to a second end disposed outside of the first part, wherein the hollow tubular member is attached to the piston such that translation of the piston via a pressure difference between the first and the second chamber portions established by the pump results in translation of the hollow tubular member; and a second part attached to the second end of the hollow tubular member such that the second part moves with the hollow tubular member during translation;

a first gripping device attached to the first part and a second gripping device attached to the second part, wherein each gripping device is configured to expand when filled with a fluid to cause the gripping device to contact the tubular channel; and repeating the following operations:

inflating the first gripping device by pumping a fluid from the second gripping device to the first gripping means;

pushing the second part from the first part by pressurizing the first piston pressure chamber and depressurizing the second piston pressure chamber;

inflating the second gripping means by pumping the fluid from the first gripping device to the second gripping device; and pulling the first part to the second part by pressurizing the second piston pressure chamber and depressurizing the first piston pressure chamber.

* * * * *